US007628674B2

(12) United States Patent
Nuttall et al.

(10) Patent No.: US 7,628,674 B2
(45) Date of Patent: Dec. 8, 2009

(54) FOLDING TRACK ASSEMBLIES

(75) Inventors: Michael Nuttall, South Pasadena, CA (US); Stacy O'Connor, Long Beach, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/744,793

(22) Filed: May 4, 2007

(65) Prior Publication Data

US 2008/0009224 A1 Jan. 10, 2008

Related U.S. Application Data

(60) Provisional application No. 60/798,035, filed on May 4, 2006.

(51) Int. Cl.
*A63H 18/00* (2006.01)

(52) U.S. Cl. ..... 446/444

(58) Field of Classification Search ..... 446/435, 446/444; 238/10 E, 10 A, 10 R
See application file for complete search history.

(56) References Cited

U.S. PATENT DOCUMENTS

| | | | | |
|---|---|---|---|---|
| 1,715,891 | A | 6/1929 | Beck | |
| 2,992,598 | A | 7/1961 | Einfalt | |
| 3,477,172 | A | 11/1969 | Polewski | |
| 3,545,757 | A | 12/1970 | Tepper et al. | |
| 3,559,334 | A | 2/1971 | Pearlman et al. | |
| 3,599,365 | A | 8/1971 | Carver et al. | |
| 3,621,602 | A | 11/1971 | Barcus et al. | |
| 3,674,269 | A * | 7/1972 | Cooper et al. | 463/60 |
| 3,814,021 | A | 6/1974 | McHenry | |
| 3,858,875 | A * | 1/1975 | Nemeth et al. | 273/460 |
| 3,883,987 | A | 5/1975 | Joshi et al. | |
| 3,908,989 | A | 9/1975 | Meyer | |
| 3,952,442 | A | 4/1976 | Livesey et al. | |
| 4,094,089 | A | 6/1978 | Sano | |
| 4,198,049 | A * | 4/1980 | Kurita | 273/119 A |
| 4,249,733 | A * | 2/1981 | Eddins et al. | 463/69 |
| 4,272,918 | A * | 6/1981 | Inoue | 446/300 |
| 4,349,983 | A | 9/1982 | Kilroy et al. | |
| 4,383,688 | A | 5/1983 | Prehodka | |
| 4,423,871 | A | 1/1984 | Mucaro | |
| 4,472,906 | A | 9/1984 | Cook et al. | |
| 4,504,242 | A | 3/1985 | Crain et al. | |
| 4,513,966 | A * | 4/1985 | Mucaro et al. | 238/10 F |
| 4,513,967 | A * | 4/1985 | Halford et al. | 273/108 |
| 4,519,789 | A | 5/1985 | Halford et al. | |
| 4,536,168 | A | 8/1985 | Stephens | |
| 4,550,910 | A * | 11/1985 | Goldfarb et al. | 104/305 |
| 4,558,867 | A | 12/1985 | Hippely | |
| 4,575,350 | A | 3/1986 | Hippely et al. | |
| 4,642,066 | A | 2/1987 | Kennedy et al. | |
| 4,661,080 | A * | 4/1987 | Goldstein et al. | 446/4 |
| 4,732,569 | A | 3/1988 | Hippely et al. | |
| D305,676 | S | 1/1990 | Ngai | |

(Continued)

FOREIGN PATENT DOCUMENTS

| | | |
|---|---|---|
| GB | 2200297 | 8/1988 |

*Primary Examiner*—Gene Kim
*Assistant Examiner*—Alyssa M Hylinski
(74) *Attorney, Agent, or Firm*—Kolisch Hartwell, P.C.

(57) ABSTRACT

Track assemblies for toy vehicles having a plurality of track segments, a plurality of gauntlet features, and an indexing mechanism configured to regulate activation of the gauntlet features.

19 Claims, 7 Drawing Sheets

U.S. PATENT DOCUMENTS 4,898,404 A 2/1990 Babcock
4,937,207 A 6/1990 Simmell et al.
4,961,716 A 10/1990 Hippely et al.
5,038,685 A 8/1991 Yoneda et al.
5,174,569 A * 12/1992 Ngai ..... 463/63
5,234,216 A 8/1993 Ostendorff
5,542,668 A * 8/1996 Casale et al. ..... 463/59
5,586,923 A 12/1996 Hippely et al.
5,643,040 A * 7/1997 Hippely et al. ..... 446/429
5,683,298 A * 11/1997 Jackson ..... 463/58
5,704,822 A * 1/1998 Nilsson ..... 446/447
5,813,351 A * 9/1998 Chen ..... 104/60
5,820,126 A 10/1998 Moore
6,216,600 B1 4/2001 Verret
6,358,112 B1 * 3/2002 Lambert et al. ..... 446/429
6,517,007 B2 * 2/2003 Kong ..... 238/10 F
6,783,419 B1 * 8/2004 Paukert et al. ..... 446/75
6,824,442 B2 * 11/2004 Andrews et al. ..... 446/405
6,913,508 B2 7/2005 Hornsby et al.
2005/0191940 A1 9/2005 Sheltman et al.
2005/0287918 A1 12/2005 Sheltman et al.

* cited by examiner

FOLDING TRACK ASSEMBLIES

This application claims the benefit of priority under 35 U.S.C. § 119(e) of provisional patent application Ser. No. 60/798,035, titled FOLDING TRACK ASSEMBLIES, filed May 4, 2006, which is incorporated herein by reference in its entirety for all purposes.

BACKGROUND

Tracks for toy vehicles may include track segments that may include substantially straight segments, or include sections of track that are sufficiently long that the resulting toy must either be assembled for use and disassembled for storage, or that render the toy difficult to transport and store.

It would be advantageous to have substantially self-contained track assemblies that can be readily stored and/or transported without disassembly, can be readily converted to an operable configuration even by young children, and which offer exciting play opportunities. The present disclosure relates generally to track assemblies for toy vehicles and, more particularly, to track assemblies having both a closed and an open configuration.

Examples of toys that include track segments are found in U.S. Pat. Nos. 4,249,733, 4,349,983, 4,937,207, and 6,358,112, each of which is hereby incorporated by reference, for all purposes.

SUMMARY

Embodiments of track assemblies for toy vehicles are provided, where the track assemblies have a plurality of track segments, a plurality of gauntlet features, and an indexing mechanism configured to regulate activation of the gauntlet features. The track assembly may have a closed configuration suitable for storage and/or transportation, and an open configuration suitable for play.

DESCRIPTION OF PREFERRED EMBODIMENTS

Figure 1:
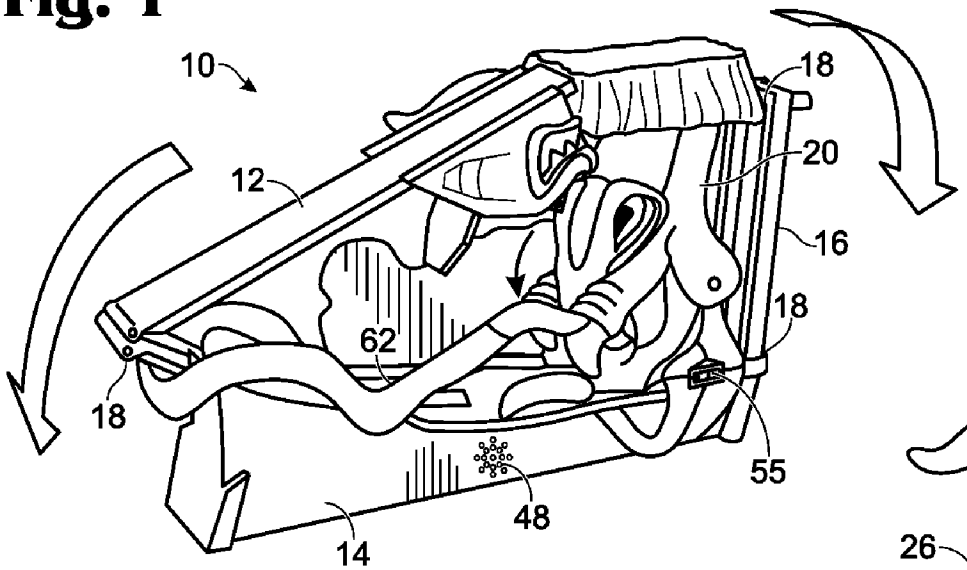
FIG. 1 depicts an exemplary track assembly in a closed configuration.
Figure 2:
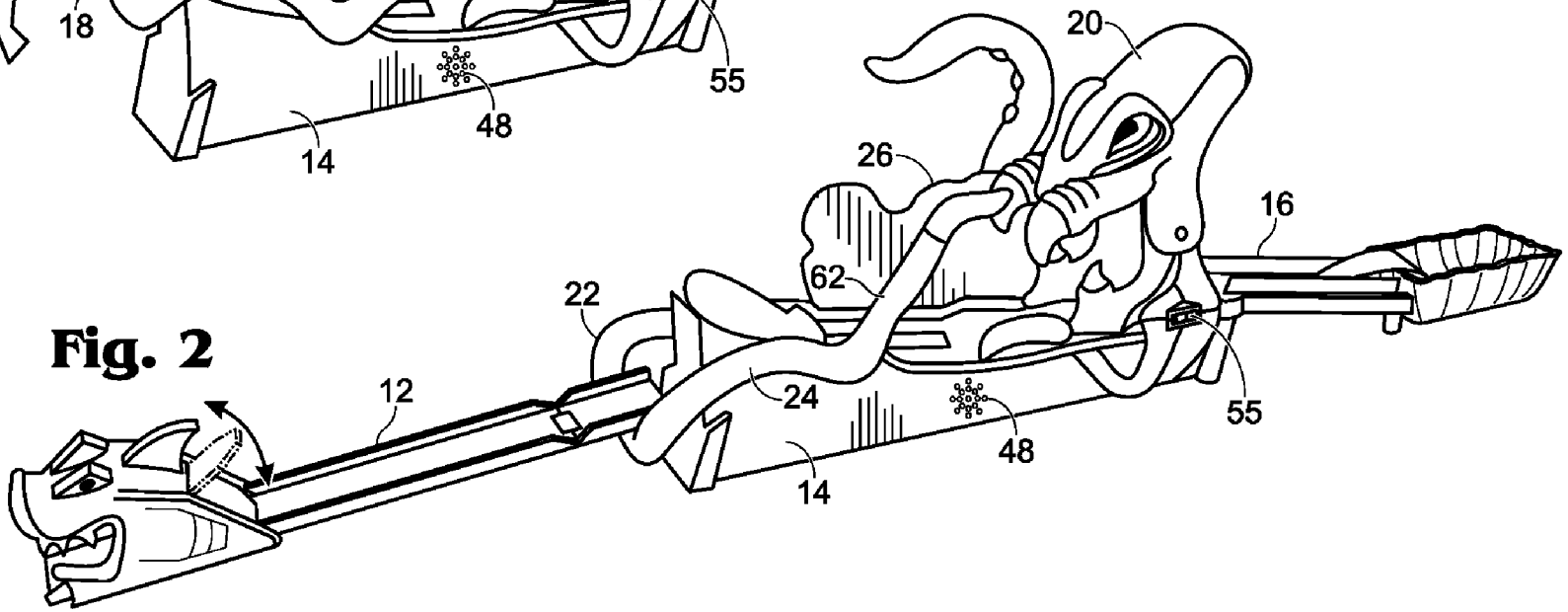
FIG. 2 depicts the exemplary track assembly of FIG. 1 in an open configuration.

An exemplary folding track assembly 10 for toy vehicles is shown in FIGS. 1-15. Track assembly 10 may include an initial or launch track segment 12, a central track segment 14, and an exit track segment 16. The open configuration of track assembly 10 features launch track segment 12 in a fully open and horizontal position, and exit track segment 16 extended in a horizontal position. The track assemblies of this disclosure typically possess at least two configurations, with at least one configuration being a "closed" configuration, as shown in FIG. 1, and at least one configuration being an "opened" configuration, as shown in FIG. 2. Track assembly 10 may incorporate multiple pivot- or hinge-points 18, so that the track assembly may be folded for storage.

The closed configuration is a configuration of the track assembly that is relatively compact. Typically the closed configuration is suitable for storage of the track assembly, or transportation of the track assembly. The opened configuration is a configuration of the track assembly that is operable, that is, the track assembly is configured for play. A given track assembly may have one or more closed configurations, and one or more open configurations. A track assembly may also have one or more intermediate configurations, where a portion of track is in an intermediate position between its open and closed positions, or alternatively, where less than all of the track portions are in an open configuration.

In the closed configuration, the launch track segment and the exit track segment may be folded against the central track segment. Further, a portion of the launch track segment may positively interact with a portion of the central track segment or the exit track segment, for example by interlocking or snapping together. One or more components of the track assembly may be reconfigured in order to further facilitate folding of the track assembly. For example, as shown in FIG. 1, when track assembly 10 is in a closed configuration, the upper portion of octopus head 20 may be pivoted downward, so that exit track segment 16 may be folded more compactly. One or more stylistic or operational components of the track assembly may be pivoted, folded, or otherwise retracted in order to facilitate the folding of the track assembly into its closed configuration.

The track assembly may be configured to represent a particular environment or venue. The track assembly may include one or more licensed characters, such as a superhero, good-guy, villain, television personality, comic character, or the like. The track assembly may be sized and adapted for use with a particular type of toy vehicle, such as skateboards, bicycles, motorcycles, trains, cars, or trucks. In a particular embodiment, the track assembly is configured to be compatible with HOT WHEELS toy vehicles.

Track assembly 10, as shown in FIGS. 1-15, may include stylistic elements configured to evoke an amusement park located on a pier which is being attacked by a malevolent giant octopus. Such features may include one or more tentacles 22 and 24, and/or background panels 26 depicting the amusement park. The track assembly may also include one or more toy figures that may interact with one or more features of the track assembly, including but not limited to one or more gauntlet features of the track assembly. Such toy figures may include clothing or accessories consistent with the theme of the track assembly. The track assembly may be designed such that when it is in the closed configuration, the track assembly features a diorama or depiction that reinforces the theme of the track assembly.

Typically, the initial or launch segment 12 of the track assembly features the initial or starting position of the toy vehicle. The launch segment optionally includes one or more means of propelling the toy vehicle onto the track assembly, including springs, rotating frictional rollers, gravity, magnets, or other propulsive methods.

The central track segment 14 of the track assembly typically includes one or more track features. By track feature is meant a portion of the track that acts upon the toy vehicle, for example such that a vehicle must pass adjacent to, through, over, or under a feature, or where a feature may divert the toy vehicle, dislodge the toy vehicle from the track, and/or prevent the vehicle from reaching the exit track segment. Track features may include passageways, forks in the track segment, overpasses, underpasses, jumps, and/or obstacles in the track. Where a track feature includes a mechanism to divert the toy vehicle, capture the toy vehicle, or launch the toy vehicle from the track assembly, the track feature may be considered a "gauntlet" feature. In one embodiment, a gauntlet feature is a track feature that is configured to halt, divert, or delay the toy vehicle as it progresses toward the terminal or exit track segment.

The exit track segment of the track assembly typically includes the terminus of the toy vehicle track. The exit track segment may include one or more exit features, such as a stop, jump, or ramp, which assist in bringing the vehicle to a stop, or facilitates the vehicle leaving the exit track segment. Alternatively, or in addition, the exit track may include a destination feature where the vehicle may stop or be stopped. The exit track segment may also include one or more track features.

Figure 3:
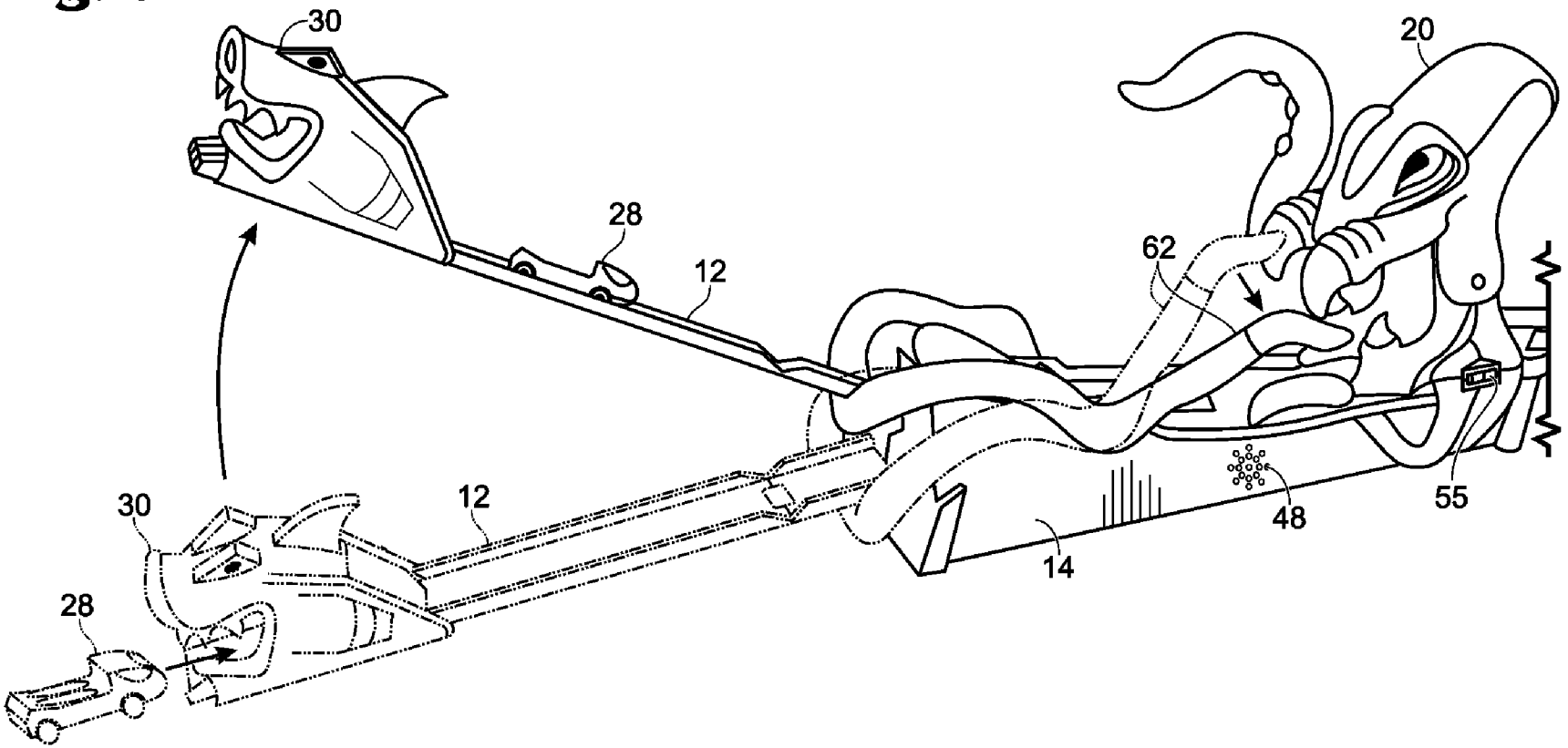
FIG. 3 depicts the exemplary track assembly of FIGS. 1 and 2, showing the elevation of the launch track segment.

With particular regard to exemplary track assembly 10, while launch track segment 12 is in the lower horizontal position, a toy vehicle 28 may be placed initially on the launch track segment 12 of track assembly 10, for example at or in the shark's head feature 30. The launch track segment may then be raised to a launch position, as indicated in FIG. 3, such that the launch track segment is inclined. As a result, vehicle 28 may roll under the influence of gravity toward and onto the central track segment 14.

The central track segment 14 of track assembly 10 may include a variety of gauntlet features. For example, the toy vehicle may interact with a gauntlet feature 32, shown in more detail in FIGS. 4 and 5, which may be configured to block and/or propel a toy vehicle upward and off the central track segment. Gauntlet feature 32 may be configured so that when it is inactive, a toy vehicle may pass over the gauntlet feature, displacing trigger 34, without interference. However, when gauntlet feature 32 is active, when a car impacts trigger 34, section 36 of the vehicle track may be abruptly elevated while the vehicle is passing over that track section. As a result, the progress of the vehicle may be interrupted, for example by projecting the vehicle from the track segment. Gauntlet feature 32 may be adapted to resemble a portion of a pier or boardwalk being lifted by an octopus tentacle, in keeping with the overall theme of track assembly 10.

In order to provide an impetus for any or all gauntlet features or other moving portions of the track assembly, the track assembly is typically first energized, for example by compressing or winding up one or more springs, flexing one or more resilient members, or stretching one or more elastic members. Each gauntlet feature may incorporate an individual energizing mechanism, and may be individually energized (or reset) by the user. Alternatively, the track assembly may incorporate a single source of motive force that may drive each track feature or gauntlet feature. The track assembly may incorporate one or more motors with associated power sources so that the given track features and/or gauntlet features are activated without requiring the corresponding mechanism to first be energized by the user. In a particular embodiment of the track assembly, each gauntlet feature may include an energizing element, such as a spring, a resilient element, or other mechanical apparatus, to impart a motion sufficient to actuate the feature when triggered. The energizing element may be reset for subsequent vehicles.

Figure 4:
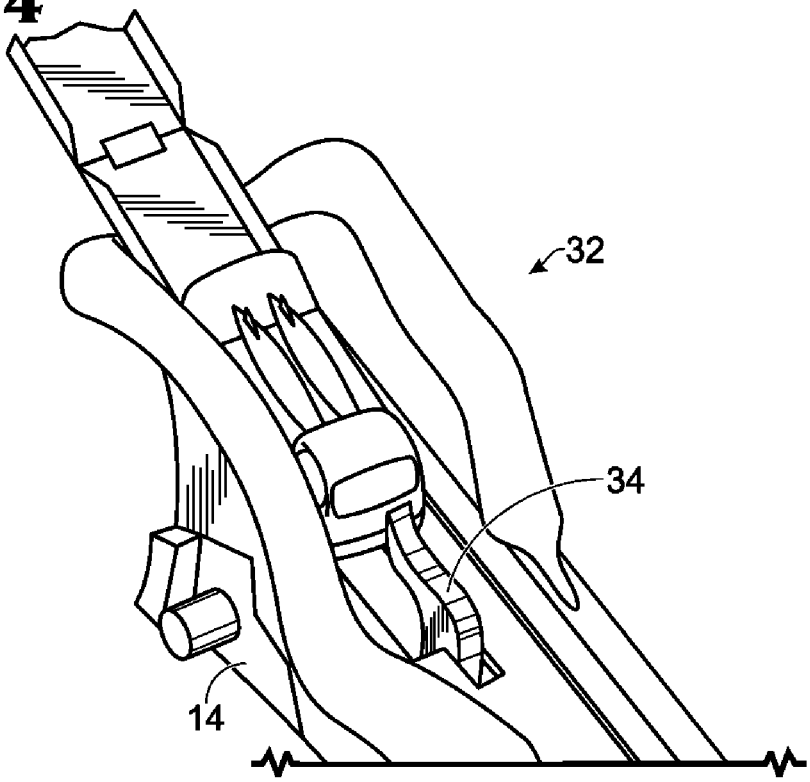
FIG. 4 depicts a gauntlet feature of the exemplary track assembly of FIGS. 1 and 2, including the gauntlet feature trigger.
Figure 5:
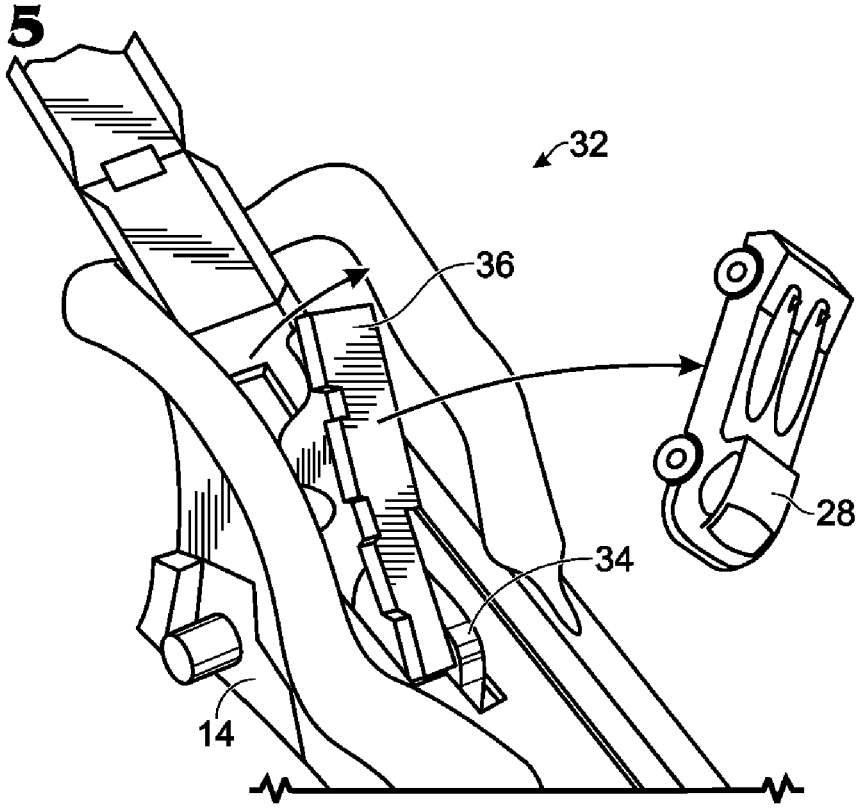
FIG. 5 depicts the gauntlet feature of FIG. 4 after it has been triggered.

Each gauntlet feature may be individually and independently triggered by a switch, pressure plate, or other device activated by the passage of the toy vehicle. Alternatively, the gauntlet feature may be triggered by a timing element that is initiated by a user, or by the passage of the toy vehicle at a remote location. Alternatively, the gauntlet feature may be manually triggered by the track assembly user. As shown for gauntlet feature 32, as shown in FIGS. 4 and 5, the feature may be triggered by a toy vehicle striking trigger 34.

Figure 6:
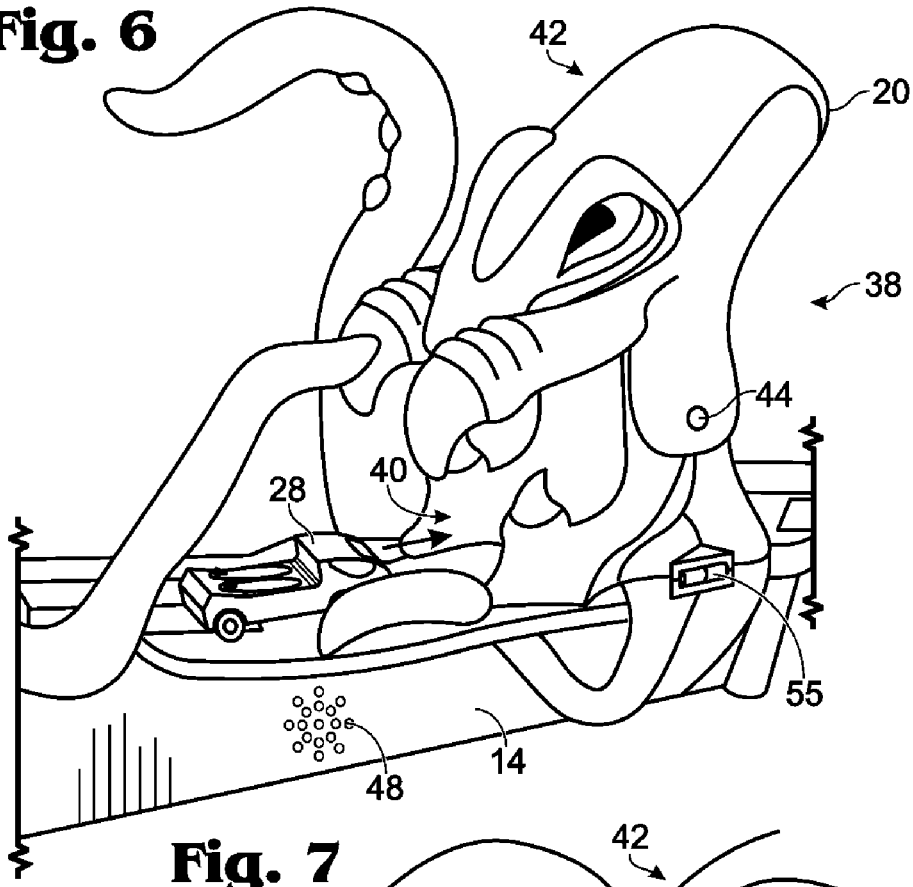
FIG. 6 depicts an alternative gauntlet feature of the exemplary track assembly of FIGS. 1 and 2, including the biasing of the octopus head to set the gauntlet feature.

If a vehicle avoids gauntlet feature 32, the toy vehicle may interact with gauntlet feature 38 by entering mouth 40 of octopus head 42, as shown in FIG. 6. Octopus head 42 may include a pivot point 44 that permits mouth 40 to be opened or closed by tilting upper octopus head 20 back. Gauntlet feature 38 may include an energizing element as defined above, such as a spring, to bias mouth 40 to be closed if it is not held open by a restraining mechanism. The upper head may be pivoted, the mouth opened, and the restraining mechanism set so that the mouth remains open until the gauntlet feature is triggered. In one aspect of the gauntlet feature, the restraining mechanism is automatically engaged when the head is pivoted back.

Figure 7:
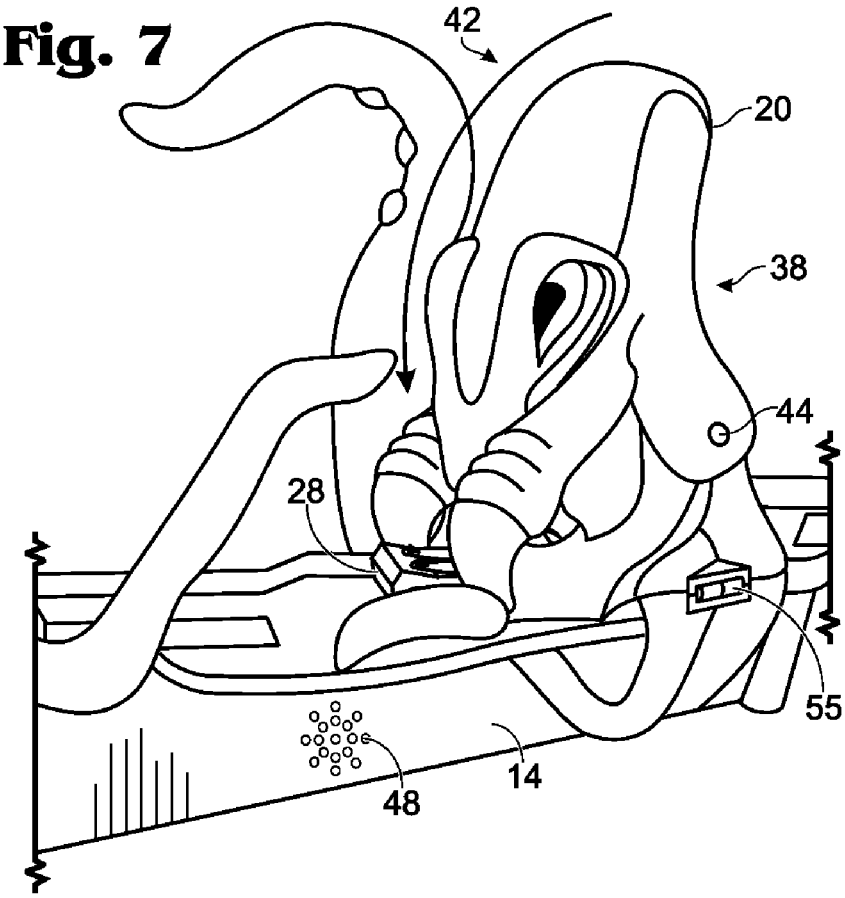
FIG. 7 depicts of the gauntlet feature of FIG. 6 after it has been triggered.

When gauntlet feature 38 is inactive, a toy vehicle may pass through the octopus mouth 40 and exit the central track segment without interference. However, when gauntlet feature 38 is active, a trigger may be extended above the track surface within the space defined by mouth 40. When toy vehicle 28 strikes the trigger, the restraining mechanism may be disengaged, resulting in upper octopus head 20 pivoting downward, and mouth 40 closing. Additionally, the trigger may remain in an extended position above the track when triggered, thereby stopping the toy vehicle 46 within mouth 40, as shown in FIG. 7, thereby enhancing the illusion that octopus head 42 is "eating" the toy vehicle.

Each gauntlet feature may optionally incorporate additional electronic and/or mechanical features, including light and sound effects, among others. In one example, the eyes of the octopus head may be configured to become illuminated. Illumination of the eyes may be activated manually by the user, or the illumination of the eyes may be triggered, such as by the passage of a toy vehicle through mouth 40. Triggering of an individual gauntlet feature may optionally trigger an associated sound effect from speaker 48 housed in central track segment 14. For example, each gauntlet feature, when triggered, may be accompanied by a comment from the character of the octopus, and/or an appropriate sound effect.

If a toy vehicle is able to avoid each of the gauntlet features of the central track segment, the vehicle exits the central track segment via passing through the mouth 40 of octopus 42. The vehicle may then travel down exit track segment 16.

Figure 8:
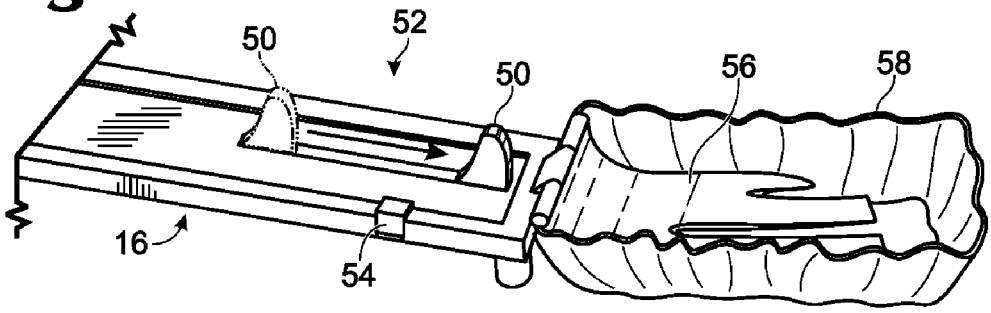
FIG. 8 depicts a feature of the exit track segment of the exemplary track assembly of FIGS. 1 and 2, including a vehicle stop, and trigger for a vehicle launcher.

An exit track segment may include one or more exit features. For example, exit segment 16 may simply terminate. Alternatively, or in addition, exit track segment 16 may include a vehicle stop 50, which stops the progress of the vehicle along the exit track segment, as shown in FIG. 8. Stop 50 may further additionally be a component of an additional launch mechanism 52, which may be configured to propel the toy vehicle either forward or backwards along the track segment. More specifically, launch mechanism 52 may be configured to be energized by manually positioning trigger stop near the terminus of exit track segment 16 against a biasing force. Releasing stop 50 permits it to impel the toy vehicle back along the exit track segment and into gauntlet feature 38. Launcher 52 may be activated automatically or manually by depressing an actuator or trigger 54.

Figure 9:
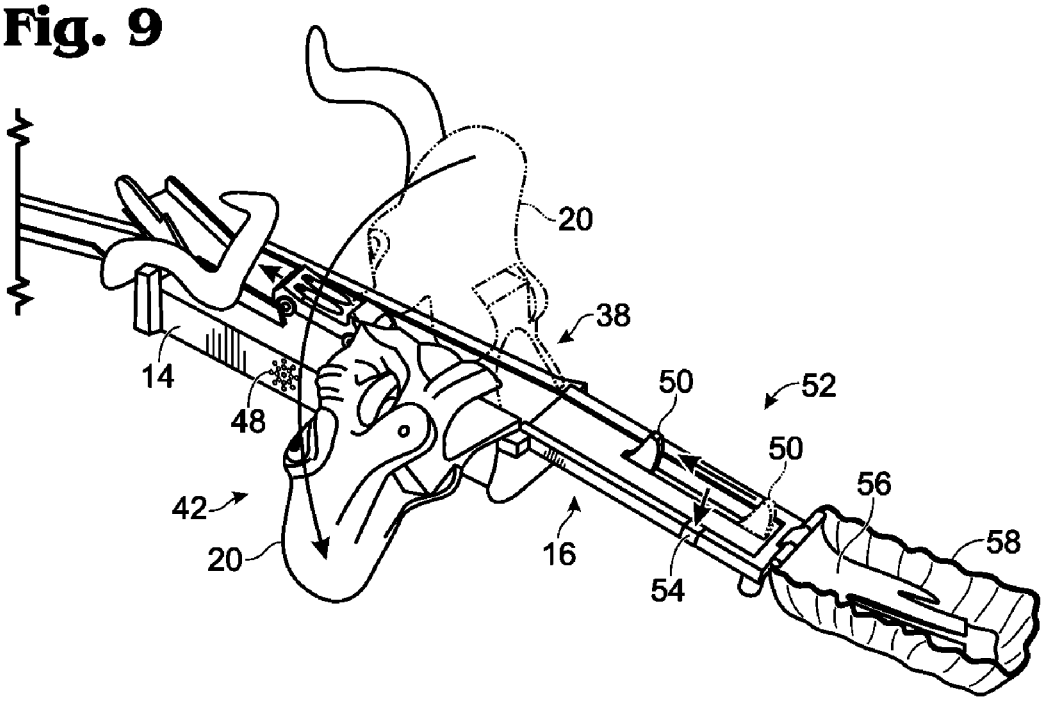
FIG. 9 depicts an additional feature of the exemplary track assembly of FIGS. 1 and 2.

Gauntlet feature 52 may be additionally configured so that a toy vehicle entering the feature from the direction of the exit ramp will engage an additional trigger. For example, gauntlet feature 38 may incorporate a one-way gate, configured so that a toy vehicle entering the octopus mouth 40 from the central track segment will pass through the gauntlet feature, but a toy vehicle entering the gauntlet feature 38 from the exit track segment will trigger an additional effect. For example, octopus head 42 may be held in position on the central track segment against a bias, such as a spring or other biasing mechanism, and triggering the one-way gate may release the octopus head 42. The head may then be displaced from the central track segment, for example by popping entirely off the track segment or by pivoting to one side of the track segment while maintaining an attachment to the track segment through a hinge 55, as shown in FIG. 9. In a particular example, actuating one-way gate may release a catch, permitting that head 42 to be impelled upward by a spring contained within the interior of central track segment 14 via, for example, a peg or post. This actuation may be accompanied by sound effects or other mechanical effects to indicate that the user has "defeated" the octopus.

Figure 10:
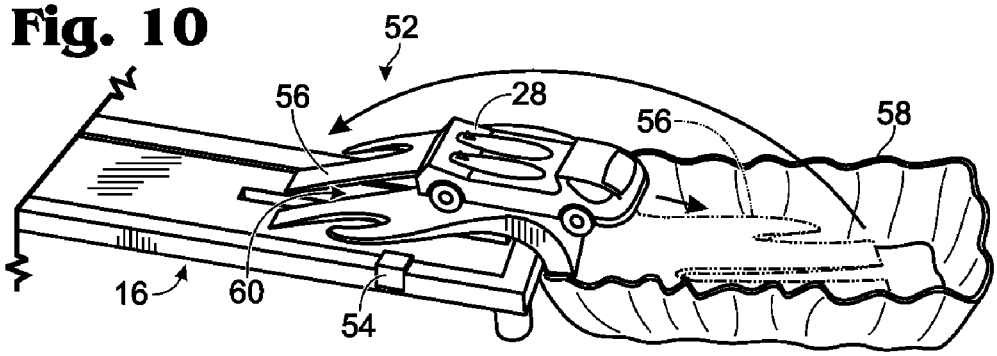
FIG. 10 depicts an additional feature of the exit track segment of the exemplary track assembly of FIGS. 1 and 2.

Alternatively, or in addition, exit segment may include a ramp or jump, so that a car that successfully traverses the track assembly may be launched into the air, or directed to a vehicle destination. For example, ramp 56 may be raised and pivoted from its position nested in dunk tank 58 so that stop 50 is covered by the ramp surface, as shown in FIG. 10. A toy vehicle traversing the exit track segment may then be launched into a vehicle destination, such as dunk tank 58. Ramp 56 may be configured with a slot or gap 60 so that stop 50 can move freely if launcher 52 is activated.

The dunk tank 58 is configured to receive the toy vehicle. The dunk tank may be empty. Alternatively, dunk tank 58 may be filled with water, or some other liquid or semi-liquid substance, or a granular composition such as sand. Where the pool includes water, the water may be selected to be cold or warm water in combination with the use of toy vehicles having thermochromic paint or decorations. For example, a car may be propelled into a pool where the water temperature has been selected to create the thermochromic appearance of designs and/or features on the vehicle that complement the theme of the track assembly.

The triggering of a first gauntlet feature may prevent the toy vehicle from reaching subsequent gauntlet features. The track assembly may therefore incorporate one or more mechanisms that determine which of a plurality of gauntlet features will be active at any given time. For example, a lever, switch or other mechanism may selectively determine which gauntlet features will interact with a toy vehicle. The determination may be deliberate, or the mechanism itself may randomly or pseudorandomly determine which gauntlet features are active.

In one embodiment of the disclosed track assembly, elevating the launch track segment in order to propel the toy vehicle, as shown in FIG. 3, may activate a mechanism that determines which gauntlet features will interact with the vehicle. Any suitable mechanism for activating and deactivating the selected gauntlet features may be used. For example, raising the launch track segment may advance an indexed cam having a plurality of cam steps that in turn determine which of the gauntlet features will interact with a toy vehicle traversing the track assembly. That is, placing the car at the end of the launch segment and pressing down on an appropriate tentacle 62 will lift the car into the drop/launch position, and simultaneously advance the sequential cam to a next or different position. This allows the behavior of the toy vehicle on the track assembly to change from use to use, and therefore the subsequent gameplay may vary in an exciting and less predictable way.

Figure 11:
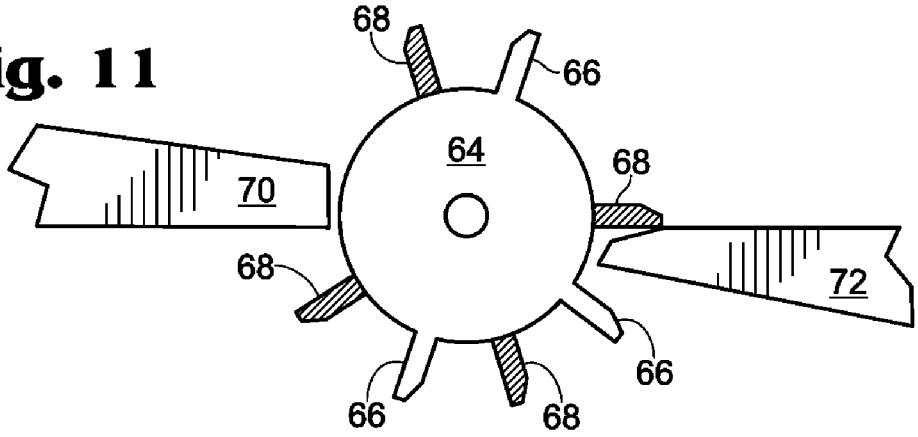
FIG. 11 depicts an indexed cam mechanism that may be used to activate selected gauntlet features of the exemplary track assembly of FIGS. 1 and 2.
Figure 12:
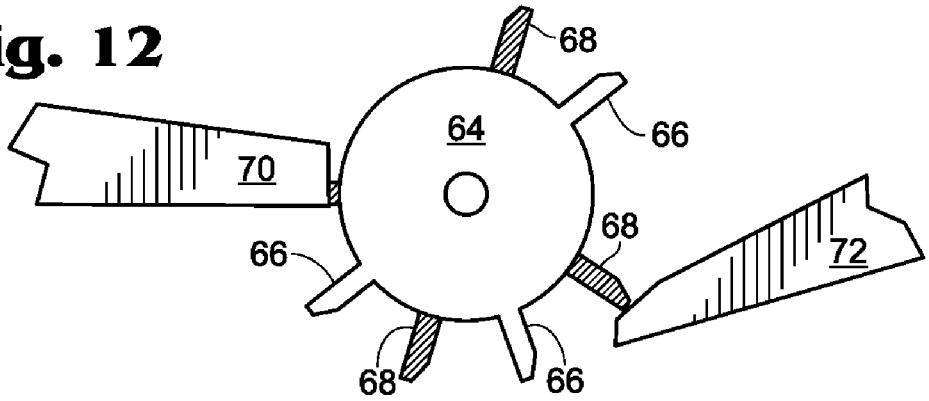
FIGS. 12-14 depict the indexed cam mechanism of FIG. 11 after incremental advancements.
Figure 13:
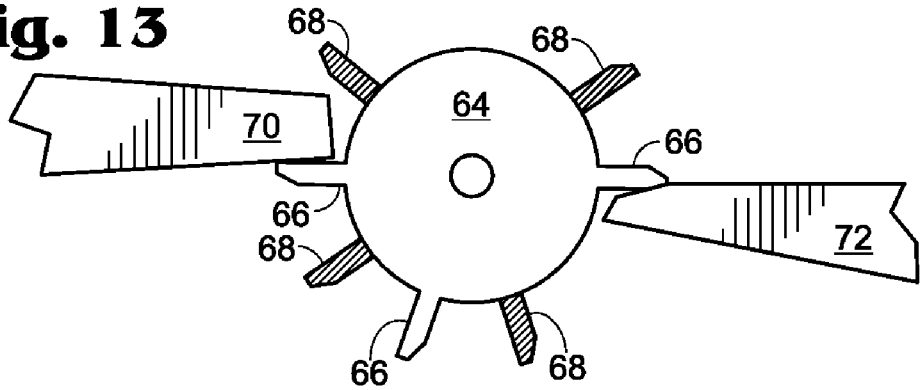
Figure 14:
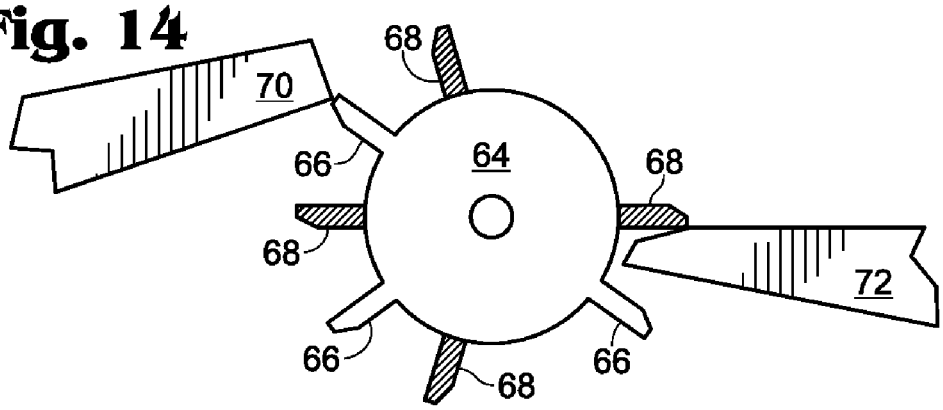

An exemplary sequential cam 64 is shown in FIGS. 11-14. Where an indexed cam is used to sequentially activate and deactivate the gauntlet features, the cam may additionally incorporate angled gear teeth (not shown), so that the cam may be advanced using a pawl and ratchet mechanism. The pawl may be coupled to the raising of the launch track segment, so that raising the launch track segment advances the pawl and thereby incrementally advances the cam. The cam may additionally incorporate two or more sets of cam teeth, each set of teeth having a corresponding cam follower, such that the interaction of the cam follower and the teeth determines whether a given gauntlet feature is active or inactive. For example as shown in FIG. 11, cam 64 includes indexing teeth 66 and 68, and corresponding cam followers 70 and 72, respectively. The orientation of the cam and cam followers may be configured so that cam teeth 66 interact only with cam follower 70, while cam teeth 68 interact only with cam follower 72.

As shown in FIG. 11 cam followers 70 and 72 are in a neutral, or inactive position, and the gauntlet features coupled to the cam followers are therefore inactive. In the case of exemplary cam 64, the cam teeth are separated by multiples of thirty-six degrees, and the ratchet and pawl mechanism is therefore configured to advance the cam thirty-six degrees per activation (corresponding to ten indexed steps per complete rotation. Advancing the cam to the next indexed position, corresponding to a rotation of the cam of 36 degrees, results in the configuration shown in FIG. 12. In this configuration a cam tooth 68 has displaced cam follower 72, resulting in the activation of gauntlet feature 38, while gauntlet feature 32 remains inactive. An additional thirty-six degree rotation, and both gauntlet features are again inactive. Yet another thirty-six degree rotation results in cam follower 70 being displaced by one of cam teeth 66, so that gauntlet feature 32 becomes active, while gauntlet feature 38 becomes inactive.

The gauntlet activation pattern of cam 64 repeats after ten advances of the indexing mechanism, providing sufficient irregularity in the order of activation that a user may find predicting the active gauntlet configuration to be difficult. Such a mechanism may be considered to activate selected gauntlet features in a pseudorandom fashion. Although the cam of FIGS. 11-14 is configured so that both gauntlet features are not active at the same time, where a particular gauntlet feature can interact with a vehicle without halting or disrupting travel through the track assembly, the cam may be configured to permit simultaneous activation of gauntlet features. The arrangement and spacing of teeth on the cam may be selected to activate the permitted gauntlet features in any order or combination desired. Similarly, the cam may be configured to regulate the activation of more than two gauntlet features.

The cam followers may be coupled to a selected gauntlet feature via a variety of functional couplings. The cams maybe coupled to individual gauntlet features via link rods, springs, levers, or any other suitable mechanical coupling or combination of mechanical couplings. For example, the position of cam follower 70 may determine whether trigger 34 of gauntlet feature 32 is coupled to the release mechanism for the gauntlet feature, or the trigger can be freely displaced. Similarly, the position of cam follower 72 may determine whether the trigger for gauntlet feature 38 is raised into position to be struck by a toy vehicle, or is retained below the surface of the central track segment.

Figure 15:
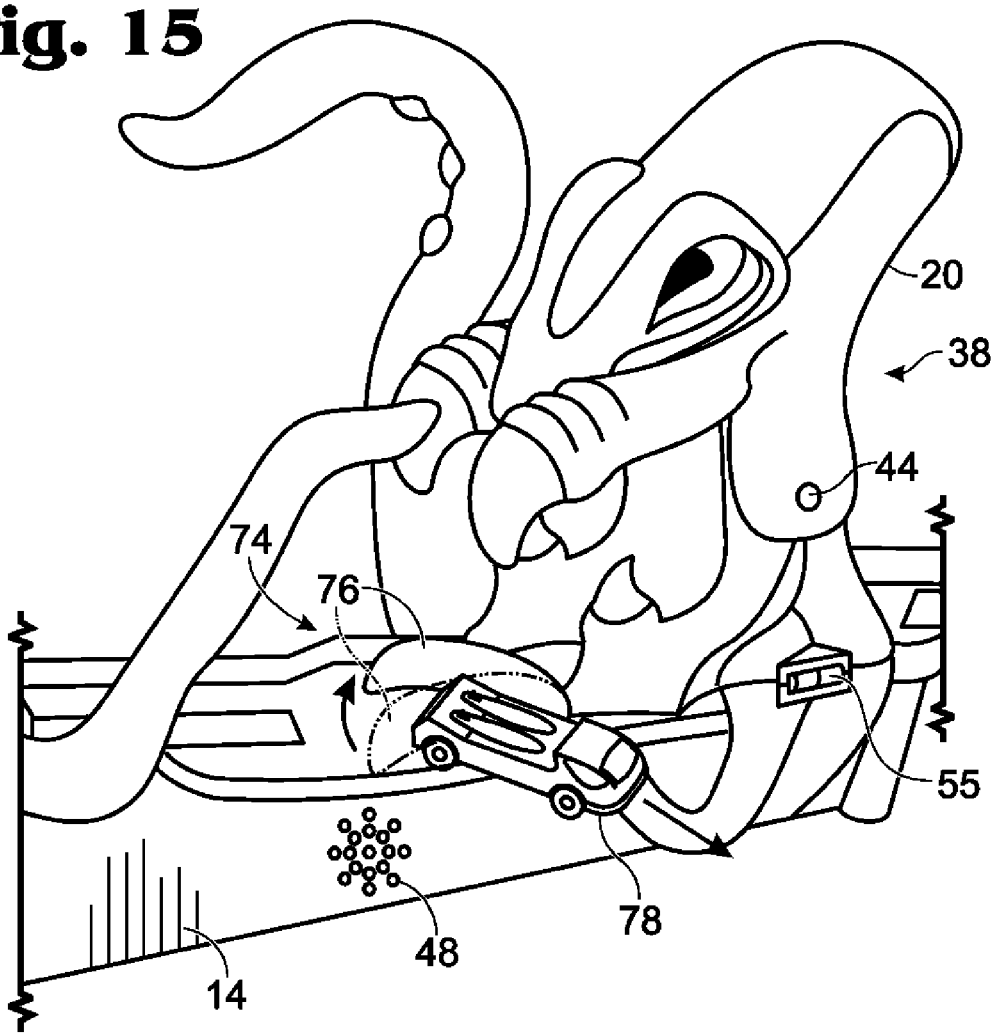
FIG. 15 depicts an additional feature of the central track segment of the exemplary track assembly of FIGS. 1 and 2.

Additional gauntlet features may be manually activated. For example, if a toy vehicle progresses beyond gauntlet feature 32, an additional gauntlet feature 74 may divert the toy vehicle from the central track segment. For example a tentacle segment 76 may be shaped such that when pivoted into the vehicle's path on the central track segment, tentacle segment 76 diverts toy vehicle 78 from the track segment, as shown in FIG. 15. The vehicle may be diverted by any of a variety of mechanical elements such as ramps, bumpers, guide rails, etc. Although tentacle segment 76 may be placed into the toy vehicle path by an automatic triggering mechanism, tentacle segment may be manually pivoted into a position obstructing the track segment by a user, as in the embodiment shown in FIG. 15. Upon being diverted, the vehicle may simply leave the track segment, or the vehicle may be diverted to a particular destination. For example, the vehicle may be diverted into an obstacle or diverted to a vehicle destination, as discussed previously.

Although the track assembly is depicted and described as having a particular sequence of track segments, and gauntlet features, any suitable sequence of track segments and/or gauntlet features may be utilized to form the disclosed track assembly.

As discussed above, various aspects of the operation of the track assembly may be accompanied by prerecorded or electronically generated sounds. In particular, activation of one or more gauntlet features, capture features, or diversion features may include sound effects. The sound effects may include music samples. The sound effects may include speech, either recorded or synthesized. The recorded speech may include sound effects consistent with the action of the various gauntlet features.

The track assembly may be fabricated from any suitable material, or combination of materials, such as plastic, foamed plastic, wood, cardboard, pressed paper, metal, or the like. A suitable material may be selected to provide a desirable combination of weight, strength, durability, cost, manufacturability, appearance, safety, and the like. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, or the like. Suitable foamed plastics may include expanded or extruded polystyrene, or the like.

The disclosed track assemblies offer a number of advantageous properties. The track assemblies may be substantially self-contained, they can be readily converted to an operable configuration without requiring disassembly or reassembly, and they offer an exciting play experience that includes a pseudo-random activation of gauntlet features.

Although the present invention has been shown and described with reference to the foregoing operational principles and preferred embodiments, it will be apparent to those skilled in the art that various changes in form and detail can be made without departing from the spirit and scope of the invention. The present invention is intended to embrace all such alternatives, modifications and variances that fall within the scope of the appended claims.

What is claimed is:

1. A track assembly for toy vehicles comprising:

a central track segment that incorporates at least two gauntlet features;

a launch track segment coupled to the central track segment and configured to deliver a toy vehicle to the central track segment;

an exit track segment coupled to the central track segment and configured to receive the toy vehicle from the central track segment; and an indexing mechanism that includes an indexed cam having a plurality of cam teeth and cam followers, such that the position of the cam followers is configured to regulate activation of the gauntlet features, wherein each gauntlet feature is configured to stop or alter the progress of the toy vehicle.

2. The track assembly of claim 1, wherein each activated gauntlet feature is adapted be triggered by the toy vehicle.

3. The track assembly of claim 2, wherein each gauntlet feature is configured to stop or alter the progress of the toy vehicle when triggered.

4. The track assembly of claim 1, further comprising at least one gauntlet feature that is adapted to be activated manually.

5. The track assembly of claim 1, wherein the indexing mechanism is configured to activate no more than one of the gauntlet features at a time.

6. A track assembly for toy vehicles comprising:

a central track segment that incorporates at least two gauntlet features;

a launch track segment coupled to the central track segment and configured to deliver a toy vehicle to the central track segment;

an exit track segment coupled to the central track segment and configured to receive the toy vehicle from the central track segment; and an indexing mechanism that includes an indexed cam having a plurality of cam teeth and cam followers, such that the position of each cam follower determines whether the gauntlet feature coupled to that cam follower is active, wherein each gauntlet feature is configured to stop or alter the progress of the toy vehicle;

wherein the track assembly has at least two configurations including a closed configuration and an open configuration, and wherein the open configuration is suitable for play.

7. The track assembly of claim 6, wherein the exit track segment is configured to receive the toy vehicle from the central track segment after if it is not halted, diverted, or delayed by a gauntlet feature.

8. The track assembly of claim 7, wherein the exit track segment includes a launch mechanism configured to launch the toy vehicle toward the central track segment.

9. The track assembly of claim 8, wherein the central track segment further includes a track feature that is selectively triggered by a toy vehicle traveling toward the launch track segment.

10. The track assembly of claim 7, wherein the exit track segment includes a destination feature.

11. The track assembly of claim 6, where the indexed cam is configured to incrementally advance through a series of predetermined configurations, each configuration corresponding to an activation status for one or more gauntlet features, and where there is at least one configuration that corresponds to the activation of each gauntlet feature that is coupled to the indexing mechanism.

12. The track assembly of claim 11, wherein the indexed cam is coupled to the launch track segment, so that launching of the toy vehicle advances the cam.

13. The track assembly of claim 12, wherein the indexed cam is coupled to the launch track segment via a pawl and ratchet mechanism, and the launching of the toy vehicle advances the cam via the pawl and ratchet mechanism.

14. The track assembly of claim 11, wherein the indexed cam is configured to have at least ten distinct positions, so that advancing the cam produces a corresponding gauntlet activation sequence.

15. A track assembly for toy vehicles comprising:

a central track segment that incorporates at least two gauntlet features, where each gauntlet feature is configured to stop or alter the progress of a toy vehicle along the central track segment when the gauntlet feature is triggered;

a launch track segment pivotally coupled to the central track segment and configured to deliver a toy vehicle to the central track segment when the launch track segment is raised;

an exit track segment pivotally coupled to the central track segment and configured to receive the toy vehicle from the central track segment when each gauntlet feature of the central track segment is inactive; and an indexing mechanism that includes an indexed cam having a plurality of cam teeth and cam followers that is coupled to one or more gauntlet features, the indexed cam being configured to incrementally advance through a series of predetermined configurations when the launch track segment is raised, each configuration corresponding to an activation status for one or more coupled gauntlet features, and where there is at least one configuration that corresponds to the activation of each coupled gauntlet feature;

wherein the track assembly has an open configuration suitable for play; and a closed configuration formed by folding the launch track segment and the exit track segment against the central track segment.

16. The track assembly of claim 15, where the activation status for a gauntlet feature may be active or inactive.

17. The track assembly of claim 15, wherein in the closed configuration a portion of the launch track segment positively interacts with a portion of the central track segment or a portion of the exit track segment.

18. The track assembly of claim 15, wherein a first gauntlet feature is configured to divert the toy vehicle from the central track segment, and a second gauntlet feature is configured to capture the toy vehicle.

19. The track assembly of claim 18, wherein the exit track segment includes a launch mechanism configured to launch the toy vehicle back along the exit track segment to the central track segment and trigger an additional track feature.

* * * * *